United States Patent [19]

Ushimura

[11] Patent Number: 4,470,548

[45] Date of Patent: Sep. 11, 1984

[54] FUEL INJECTION NOZZLE FOR AN INTERNAL COMBUSTION ENGINE

[75] Inventor: Shoji Ushimura, Yokosuka, Japan

[73] Assignee: Nissan Motor Company, Limited

[21] Appl. No.: 428,223

[22] Filed: Sep. 29, 1982

[30] Foreign Application Priority Data

Nov. 9, 1981 [JP] Japan ..... 56-179243

[51] Int. Cl.[3] ..... B05B 1/30

[52] U.S. Cl. ..... 239/533.3

[58] Field of Search ..... 239/533.1-533.12, 239/585, 562

[56] References Cited

FOREIGN PATENT DOCUMENTS 663301 8/1938 Fed. Rep. of Germany .
1046950 12/1958 Fed. Rep. of Germany .
2803774 1/1978 Fed. Rep. of Germany .
2905396 8/1980 Fed. Rep. of Germany ... 239/533.2

OTHER PUBLICATIONS

Motortechnische Zeitschrift 41 (1980), 7/8.

*Primary Examiner*—John J. Love
*Assistant Examiner*—James R. Moon, Jr.
*Attorney, Agent, or Firm*—Lowe, King, Price & Becker

[57] ABSTRACT

A fuel injection nozzle for an internal combustion engine includes a hollow nozzle body and a valve member liftably disposed in the nozzle body. The nozzle body has an orifice extending from the inside to the outside thereof. The valve member closes and opens the inner end of the orifice in accordance with lift of the valve member. Fuel can flow through the orifice to be injected into the engine when the valve member opens the inner end of the orifice. A nozzle geometry causes the rate of fuel injection to increase through a plateau as the valve member is lifted.

4 Claims, 3 Drawing Figures

FUEL INJECTION NOZZLE FOR AN INTERNAL COMBUSTION ENGINE

BACKGROUND OF THE INVENTION

This invention relates to a fuel injection nozzle for an internal combustion engine, such as a diesel engine. More particularly, it relates to a fuel injection nozzle including a hollow nozzle body and a valve member liftably disposed in the nozzle body to selectively close the internal openings of injection orifices in the nozzle body.

Some conventional fuel injection nozzles for diesel engines include hollow nozzle bodies and valve members liftably disposed in the nozzle bodies to selectively close the internal openings of injection orifices in the nozzle bodies. In such a fuel injection nozzle, the effective cross-sectional area of the fuel supply path including the injection orifices abruptly increases to its maximum as the valve member is lifted. Therefore, during the initial stage of fuel injection, a relatively great amount of fuel is injected into the combustion chamber of the engine. However, it is desirable to reduce somewhat the amount of fuel injected into the combustion chamber during this stage from the standpoint of decreasing combustion shocks, vibrations or sounds, and of reducing engine emissions of harmful NOx (oxides of nitrogen).

SUMMARY OF THE INVENTION

It is an object of this invention to provide a fuel injection nozzle for an internal combustion engine of the above-mentioned type which supplies a relatively small amount of fuel to the engine combustion chamber during the initial stage of fuel injection to reduce combustion shocks and emissions of harmful NOx.

In accordance with this invention, a fuel injection nozzle for an internal combustion engine includes a hollow nozzle body and a valve member liftably disposed in the nozzle body. The nozzle body has an orifice extending from the inside to the outside thereof. The valve member closes and opens the inner end of the orifice in accordance with lift of the valve member. Fuel can flow through the orifice to be injected into the engine when the valve member opens the inner end of the orifice. A nozzle geometry causes the rate of fuel injection to increase through a plateau as the valve member is lifted.

The above and other objects, features and advantages of this invention will be apparent from the following description of a preferred embodiment thereof, taken in conjunction with the drawings.

and

Figure 1:
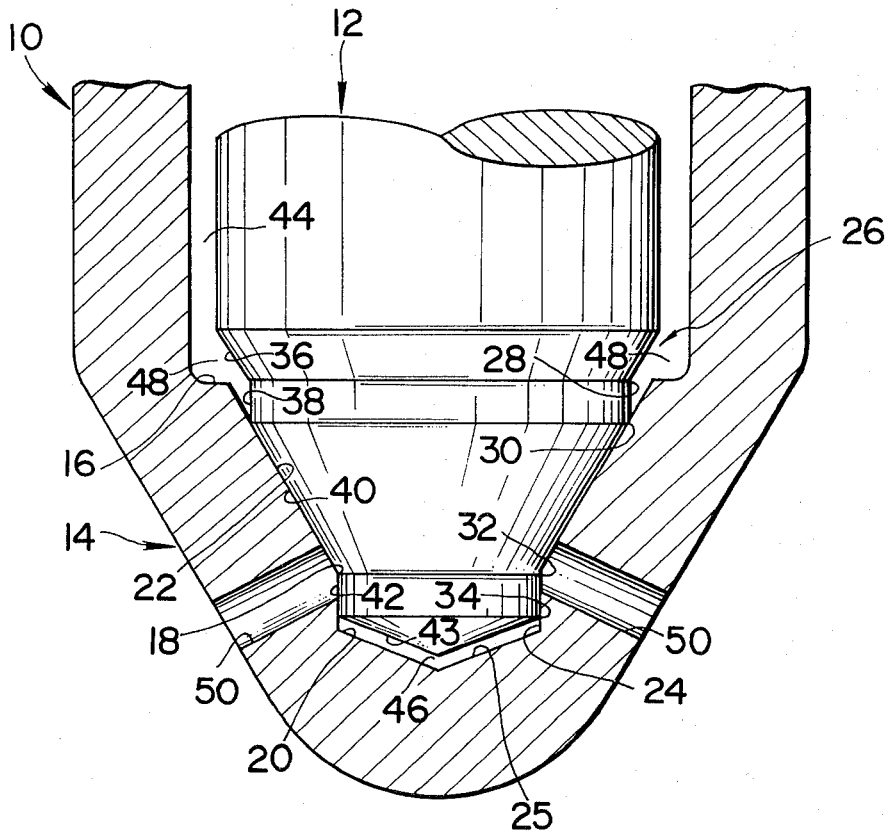
FIG. 1 is a longitudinal section view of a fuel injection nozzle of this invention.
Figure 3:
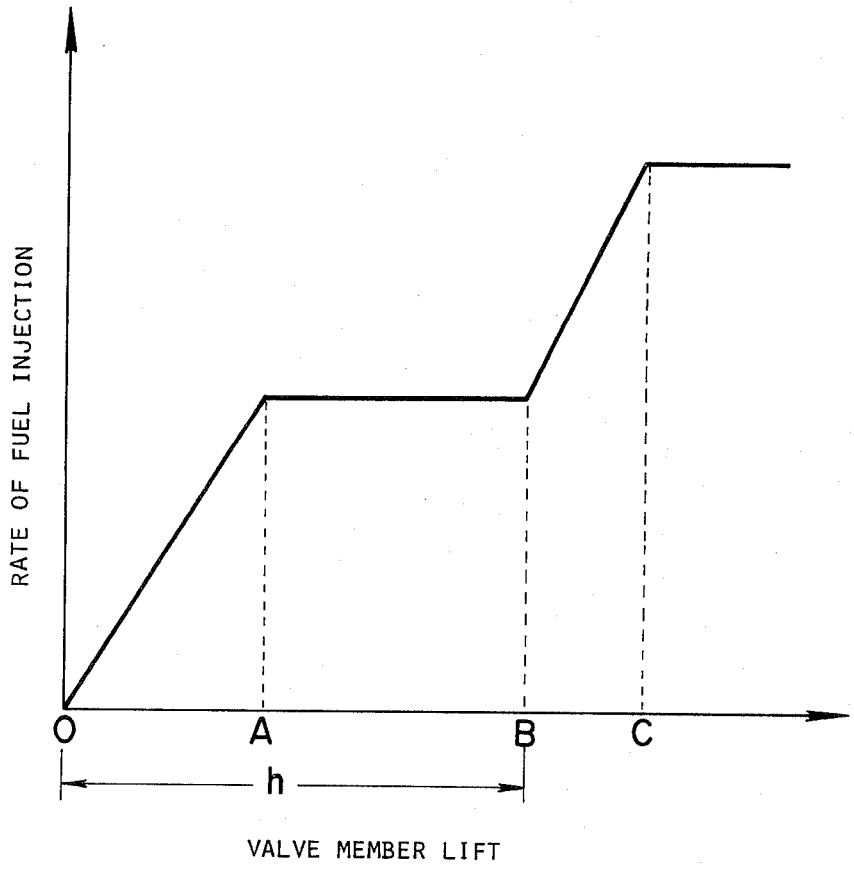

FIG. 3 is a graph of the approximate relationship between the rate of fuel injection via the fuel injection nozzle of FIG. 1 and lift of the valve member.

DESCRIPTION OF THE PREFERRED EMBODIMENT

Figure 2:
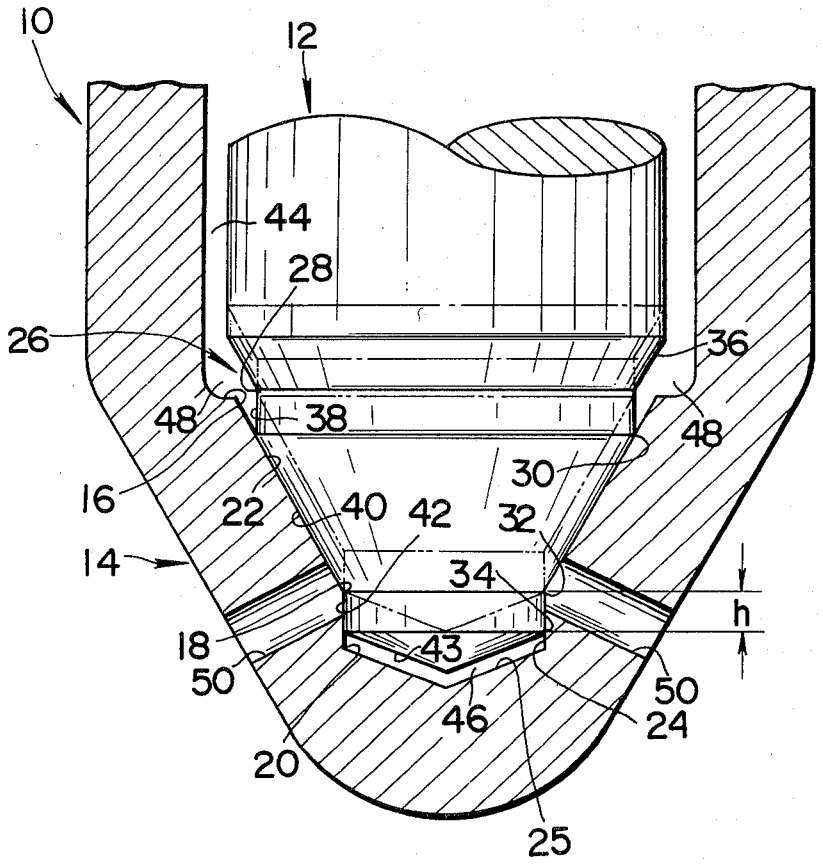
FIG. 2 is a view similar to FIG. 1 and illustrates the valve member in its normal or rest position in solid lines and in its lifted position in broken lines.

With reference to FIGS. 1 and 2, there is shown a fuel injection nozzle for an internal combustion engine, such as a diesel engine, according to this invention. The fuel injection nozzle includes a hollow cylindrical nozzle body 10 and a solid cylindrical valve member 12 coaxially disposed in the nozzle body 10. The valve member 12 can move axially relative to the nozzle body 10 in a well-known manner.

The nozzle body 10 has a hollow conical lower end 14. The inside diameter of the nozzle body end 14 decreases stepwise at a first position 16 near the top thereof, and then decreases at a first fixed slope from the position 16 to a second position 18 in the axial direction toward the bottom thereof. The inside diameter of the nozzle body end 14 is constant from the position 18 to a third position 20, and decreases at a second fixed slope from the position 20 to the bottom in the axial direction toward the bottom. In this way, the inside of the nozzle body end 14 has an annular shoulder or step 16, a frustum or frusto-conical surface 22 contiguously below the step 16, a cylindrical surface 24 contiguously below the frustum surface 22, and a conical bottom surface 25 contiguously below the cylindrical surface 24.

The valve member 12 has a roughly conical lower end 26 configured to fit snugly in the nozzle body end 14. The outside diameter of the valve member end 26 decreases at a first constant slope from the top thereof to a first position 28, is constant from the position 28 to a second position 30, and then decreases at a second constant slope from the position 30 to a third position 32 in the axial direction toward the tip thereof. The outside diameter of the valve member end 26 is constant from the position 32 to a fourth position 34, and decreases at a third constant slope from the position 34 to the tip in the axial direction toward the tip. In this way, the outside of the valve member end 26 has a first frustum or frusto-conical surface 36, a first cylindrical surface 38 contiguously below the frustum surface 36, a second frustum or frusto-conical surface 40 contiguously below the first cylindrical surface 38, a second cylindrical surface 42 contiguously below the second frustum surface 40, and a conical surface 43 contiguously below the second cylindrical surface 42.

The outside diameter of the valve member 12 above the end 26 thereof is smaller than the inside diameter of the valve body 10 above the end 14 thereof, so that an annular cylindrical space or gap 44 is formed between the valve member 12 and the valve body 10 above the respective ends 26 and 14. The slope at the nozzle body frustum surface 22 is equal to the slope at the valve member frustum surface 40. The frustum surfaces 22 and 40 conform to each other so that they can engage flush to each other. The diameter of the nozzle body cylindrical surface 24 is essentially equal to that of the valve member cylindrical surface 42 so that the cylindrical surface 42 will conform to and slideably fit flush within the cylindrical surface 24. The axial dimension of the cylindrical surface 42 is smaller than that of the cylindrical surface 24. The slope at the nozzle body conical surface 25 is equal to the slope at the valve member conical surface 43. When the valve member frustum surface 40 rests on the nozzle body frustum surface 22, the valve member cylindrical surface 42 fully fits into the nozzle body cylindrical surface 24 with a uniform space or gap 46 in the form of a conical dish formed between the tip of the nozzle body end 26 and the bottom of the nozzle body end 14. The axial dimension of the nozzle body frustum surface 22 is greater than that of the nozzle body frustum surface 40.

When the frustum surface 40 rests on the frustum surface 22, an upper portion of the frustum surface 22 near the step 16 remains uncovered. In this case, the upper portion of the frustum surface 22, the step 16, the cylindrical surface 38, and the frustum surface 36 define an annular space or gap 48 contiguously communicating with the space 44.

The nozzle body end 14 has orifices or holes 50 through the walls thereof. The orifices 50 extend radially and downwardly from the inside of the nozzle body end 14 to the outside thereof. Part of the inner end or opening of each orifice 50 is at the nozzle body cylindrical surface 24, and the other part is at the nozzle body frustum surface 22. In this embodiment, the inner end or opening of each orifice 50 is at a position including the border 18 between the surfaces 22 and 24. The inner openings of the orifices 50 are designed so that they will be fully closed when the valve member frustum surface 40 rests on the nozzle body frustum surface 22 and the valve member cylindrical surface 42 fully fits into the nozzle body cylindrical surface 24. The fuel injection nozzle is mounted in an engine cylinder head (not shown) in such a manner that the outer ends of the orifices 50 open to an engine combustion chamber.

The valve member 12 extends upward through a guide aperture (not shown) in the nozzle body 10. The guide aperture extends axially to permit the valve member 12 to slide in the axial direction. A return or nozzle helical-spring (not shown) urges the valve member 12 downward, so that the valve member frustum surface 40 normally abuts or rests on the nozzle body frustum surface 22 and the cylindrical surface 42 fully fits into the cylindrical surface 24, completely closing the inner openings of orifices 50. The nozzle body 10 has a fuel supply passage (not shown) through the wall thereof. The fuel supply passage opens to the space 44 and is in turn connected to a fuel injection pump (not shown), which supplies the spaces 44 and 46 with pressurized fuel via the fuel supply passage. The guide aperture, the return spring, and a fuel supply passage are designed in a manner similar to that of a conventional fuel injection nozzle, such as disclosed in British Patent Specification No. 1,418,574, entitled Improvements in Fuel Injection for Internal Combustion Engines.

In operation, the pressure of fuel in the spaces 44 and 48 exerts an upward force on the valve member 12 via the frustum surface 36. When the pressure of fuel in the spaces 44 and 48 exceeds a preset level, the valve member 12 is lifted against the force of the return spring from the normal, rest, or unlifted position where the valve member frustum surface 40 rests on the nozzle body frustum surface 22 and the valve member cylindrical surface 42 fully fits into the nozzle body cylindrical surface 24 as shown in the solid lines in FIG. 2, completely closing the inner openings of the orifices 50. As the valve member 12 rises, the valve member frustum surface 40 separates from the nozzle body frustum surface 22. Thus, the inner openings of the orifices 50 at the frustum surface 22 communicate with the spaces 44 and 48 through the resulting gap between the frustum surfaces 22 and 40. As a result, fuel flows from the spaces 44 and 48 into the orifices 50 through the gap between the frustum surfaces 22 and 40, and the inner openings of the orifices 50 at the frustum surface 22, passing through the orifices 50 before being injected into the engine combustion chamber. At the beginning of the valve member lift, since the cross-sectional area of the gap between the frustum surfaces 22 and 40 is smaller than the total cross-sectional area of the inner openings of the orifices 50 at the frustum surface 22, the former cross-sectional area determines the rate of fuel injection. The former cross-sectional area is essentially proportional to lift of the valve member 12, so that the rate of fuel injection increases essentially in proportion to lift of the valve member 12 as shown by the line from the point O to the point A in FIG. 3. This increase in the rate of fuel injection continues until the valve member 12 rises to the point A where the cross-sectional area of the gap between the frustum surfaces 22 and 40 is equal to the total cross-sectional area of the inner openings of the orifices 50 at the frustum surface 22.

When the valve member 12 rises to such an extent that the cross-sectional area of the gap between the frustum surfaces 22 and 40 is greater than the total cross-sectional area of the inner openings of the orifices 50 at the frustum surface 22, the latter cross-sectional area determines the rate of fuel injection. In this case, the rate of fuel injection remains essentially constant as shown by the line from the point A to the point B in FIG. 3, because further axial upward displacement of the valve member cylindrical surface 42 has essentially no influence on the total cross-sectional area of the inner openings of the orifices 50 at the frustum surface 22. This constancy in the rate of fuel injection continues until the valve member 12 rises to the point B where the lower edge of the valve member cylindrical surface 42 reaches the upper edge of the nozzle body cylindrical surface 24 as shown in the broken lines in FIG. 2. Although the inner openings of the orifices 50 at the cylindrical surface 24 are uncovered before the lower edge of the cylindrical surface 42 reaches the upper edge of the cylindrical surface 24, the overlap between the cylindrical surfaces 24 and 42 blocks communication between the orifices 50 and the space 44 via the inner openings of the orifices 50 at the cylindrical surface 24. The valve member lift h from the point O to the point B in FIG. 3 corresponds to valve member displacement h in FIG. 2.

As the valve member rises above the point B, the lower edge of the valve member cylindrical surface 42 separates from the upper edge of the nozzle body cylindrical surface 24. In this case, the inner openings of the orifices 50 at the cylindrical surface 24 are fully uncovered and communicate with the spaces 44 and 48 through the gap between the tip of the valve member end 26 and the bottom of the nozzle body end 14, the resulting gap between the lower edge of the valve member cylindrical surface 42 and the upper edge of the nozzle body cylindrical surface 24, and the gap between the frustum surfaces 22 and 40. The cross-sectional area of the gap between the edges of the cylindrical surfaces 24 and 42 is initially smaller than that of the inner openings of the orifices 50 at the cylindrical surface 24, determining the flow rate of fuel passing through the latter inner openings. Since the cross-sectional area of the gap is essentially proportional to lift of the valve member 12, the flow rate of fuel passing through the inner openings of the orifices 50 at the cylindrical surface 24 increases essentially in proportion to lift of the valve member 12. As a result, the rate of fuel injection increases, essentially, linearly with lift of the valve member 12 as shown by the line from the point B to the point C in FIG. 3, although the rate of fuel passing through the inner openings of the orifices 50 at the frustum surface 22 remains constant. This increase in the rate of fuel injection continues until the valve member 12 rises to the point C where the cross-sectional area of the gap between the edges of the cylindrical surfaces 24 and 42 comes equal to the total cross-sectional area of the inner openings of the orifices 50 at the cylindrical surface 24.

When the valve member 12 rises above the point C, the rate of fuel injection remains at an essentially constant valve defined by the total cross-sectional area of the inner openings of the orifices 50 as shown by the line to the right of the point C.

In this way, the rate of fuel injection increases through a plateau as the valve member 12 rises. The offset in the increase of the rate of fuel injection results in a decrease in the amount of fuel injected in the initial stage of fuel injection, and thus results in a reduction in combustion shocks, vibrations or sounds, and engine emissions of harmful NOx.

When the pressure of fuel in the spaces 44 and 48 drops, the valve member 12 is returned to the normal or rest position by the return spring, closing the inner openings of the orifices 50 and ending fuel injection.

The ratio of the total area of the orifice inner openings at the frustum surface 22 to that of the orifice inner openings at the cylindrical surface 24 constitutes one of the parameters determining the amount of fuel injected in the initial stage of fuel injection.

The valve member 12 in the normal or rest position fully closes the inner openings of the orifices 50 and thus blocks communication between the orifices 50 and the gap 46. Therefore, fuel trapped in the gap 46 is prevented from leaking into the engine combustion chamber through the orifices 50 when and after the valve member 12 returns to the normal position. The gap 46 can be small, so that it is possible to reduce the amount of fuel overflowing from a space defined by the tip of the valve member end 26 and the bottom of the nozzle body end 14 when the valve member 12 returns to the normal position.

It should be understood that further modifications and variations may be made in this invention without departing from the spirit and scope of this invention as set forth in the appended claims. For example, the orifices 50 may be configured as separate orifices, one opening at the frustum surface 22 and the other opening at the cylindrical surface 24.

What is claimed is:

1. A fuel injection nozzle for an internal combustion engine comprising:

(a) a hollow nozzle body having an orifice extending between inner and outer surfaces thereof; and (b) a valve member liftable within the nozzle body to open and close an inner end of the orifice, enabling fuel to flow through the orifice for injection into the engine when the valve member opens the inner end;

said nozzle body having first and second surfaces contiguous with each other, the nozzle body first surface extending obliquely with respect to the direction of lift of the valve member, the nozzle body second surface extending parallel to the direction of lift of the valve member;

said valve member having first and second surfaces contiguous with each other, the valve member first surface engaging the nozzle body first surface in flush contact when the valve member is in the unlifted position and separating from the nozzle body first surface as the valve member is lifted, the valve member second surface engaging the nozzle body second surface in flush contact when the valve member is in the unlifted position;

the inner end of said orifice being located at a position including the border between the nozzle body first and second surfaces so that part of the inner end of the orifice overlies the nozzle body first surface and another part of the inner end of the orifice overlies the nozzle body second surface;

the inner end of the orifice at the nozzle body first surface being closed by the valve member first surface when the valve member is in the unlifted position and being opened as the valve member is lifted so that fuel can enter the orifice through the inner end thereof at the nozzle body first surface from a gap formed between the nozzle body and valve first surfaces as the valve member lifts, the inner end of the orifice at the nozzle body second surface remaining closed by the valve member second surface as the valve member lifts to a predetermined position and being opened as the valve member lifts above the predetermined position so that fuel enters the orifice via the inner end thereof overlying the nozzle body second surface above the predetermined position, wherein the effective cross-sectional area of the resulting gap between the valve and nozzle body first surfaces is greater than the effective cross-sectional area of the inner end of the orifice overlying the nozzle body first surface as the valve member lifts to the predetermined position so that the rate of fuel injection is determined initially by the effective cross-sectional area of the resulting gap and then by the effective cross-sectional area of the inner end of the orifice overlying the nozzle body first surface, and is subsequently influenced by the opened inner end of the orifice at the nozzle body second surface in relation to lift of the valve member above the predetermined position.

2. A fuel injection nozzle as recited in claim 1, wherein the first surfaces are frusto-conical.

3. A fuel injection nozzle as recited in claim 1, wherein the second surfaces are cylindrical.

4. A fuel injection nozzle as recited in claim 1, wherein the first surface lie above the respective second surfaces in relation to the direction of lift of the valve member.

* * * * *